United States Patent [19]

Frum

[11] 3,963,168

[45] June 15, 1976

[54] MULTICELL CARTON INSERT

[75] Inventor: Carlos M. Frum, Chicago, Ill.

[73] Assignee: Consolidated Packaging Corporation, Chicago, Ill.

[22] Filed: Feb. 28, 1975

[21] Appl. No.: 553,980

[52] U.S. Cl. ..... 229/28 R; 229/15

[51] Int. Cl.[2] ..... B65D 5/48

[58] Field of Search ..... 229/15, 27, 28 R, 28 BC

[56] References Cited

UNITED STATES PATENTS

| | | | |
|---|---|---|---|
| 2,448,795 | 9/1948 | Grecco | 229/28 R |
| 2,515,151 | 7/1950 | Crane | 229/28 BC |
| 2,524,516 | 10/1950 | Cody | 229/28 R |
| 2,634,042 | 4/1953 | Blatt et al. | 229/28 R |
| 2,686,000 | 8/1954 | Berke | 229/28 R |

*Primary Examiner*—George E. Lowrance
*Assistant Examiner*—Douglas B. Farrow
*Attorney, Agent, or Firm*—Hill, Gross, Simpson, Van Santen, Steadman, Chiara & Simpson

[57] ABSTRACT

A one-piece multicell reinforced carton insert having an exterior boundary sidewall, a bottom floor and a plurality of cell segments, integrally formed with the exterior boundary sidewall, which may be folded together to form a plurality of reinforced cells within the insert. The cell segments depend from the bottom edge of the outer boundary wall and are folded upwardly to create bottom and sidewalls of individual cells. Adjacent cell segments are interlockable with each other and with the sidewall, and when the entire carton insert is folded in position, a plurality of cells are created in a total reinforced structure.

10 Claims, 6 Drawing Figures

MULTICELL CARTON INSERT

FIELD OF THE INVENTION

The field of art to which this invention pertains is multicell carton inserts and, in particular, to such inserts which are formed of a one piece construction to create individual cells having both sidewalls and a bottom surface.

SUMMARY OF THE INVENTION

It is an important feature of the present invention to provide an improved, multicell carton insert.

It is another feature of the present invention to provide a multicell carton insert which is formed of one-piece construction.

It is an important feature of the present invention to provide an improved, multicell carbon insert, wherein individual cell segments are interlockable with adjacent segments to form a reinforced device.

It is an additional object of the present invention to provide a reinforced carton insert as described above, wherein individual cell segments have first and second folded portions to form bottom and sidewalls of adjacent cells.

It is also an object of the present invention to provide a onepiece multicell reinforced carton insert as described above, wherein tabs are provided to extend through and from an exterior boundary sidewall to provide a cushion between the outer surface of the insert and the inner surface of a carton into which the insert is placed.

It is also an object of the invention to provide an insert as described above, wherein the upper edge of the exterior boundary sidewall has a folded depending lip, forming a U-shaped cross section or any other shape to also provide a cushion between the carton and the insert.

These and other objects, features and advantages of the present invention will be understood in greater detail from the following description and the associated drawings, wherein reference numerals are utilized to designate a preferred embodiment.

DESCRIPTION OF THE PREFERRED EMBODIMENT

It is often desirable to provide individual cells or compartments within a carton to provide individual shock protection for bottles or other glass items or any other fragile item. Furthermore, it is often desirable to provide shock protection between individual cells within a carton and the exterior surface of the carton.

Also, it is equally desirable to have the individual cells reinforced with respect to each other, and to provide a bottom to the reinforced cells, so that layers of glass or breakable items may be stacked within a single carton. The present invention provides such a structure by means of a carton insert, which is formed of a one-piece corrugated cardboard or the like which is die cut in such a way as to provide individual cell segments which may be readily folded into a completed structure which is reinforced by an interlocking relationship of the cells and which is cushioned from the inner surface of the carton into which it is placed.

Figure 4:
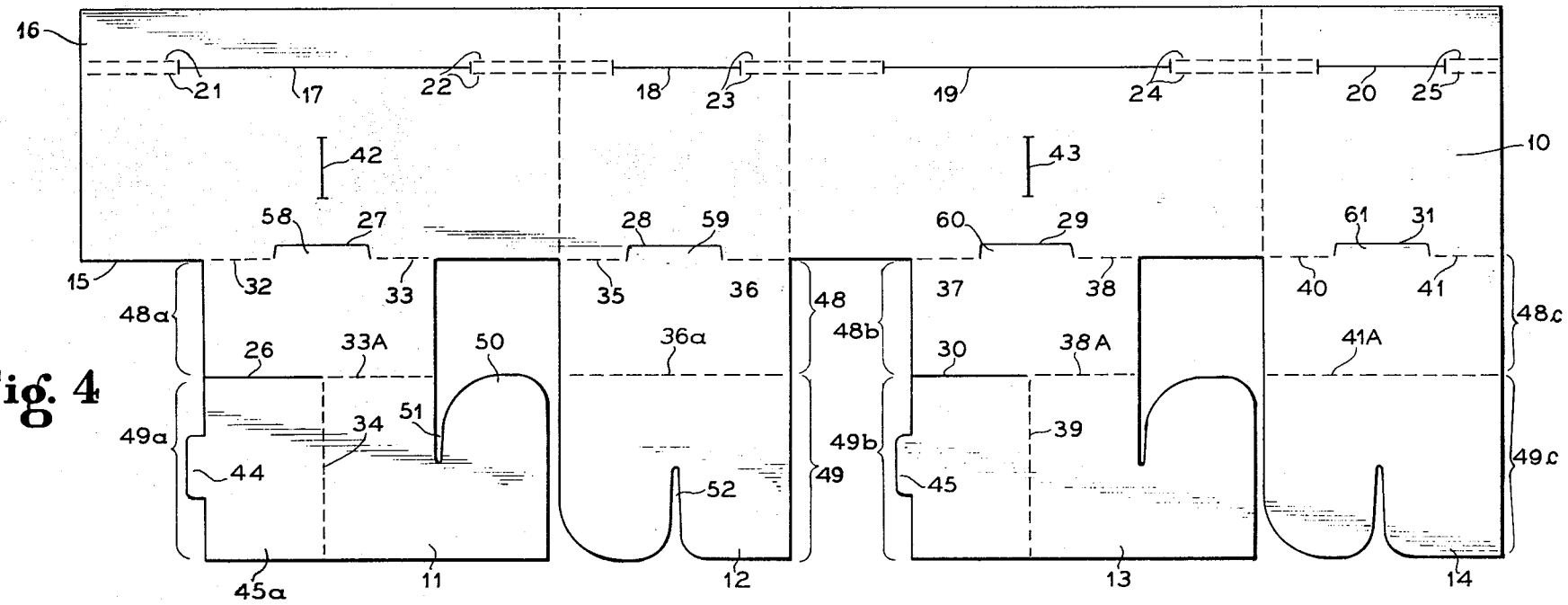
FIG. 4 shows the carton insert in a completely unfolded, planar position, as it is received from a die cutter.

Referring to the drawings in detail, FIG. 4 shows a piece of corrugated cardboard or the like which is cut in a standard die cutter to the configuration shown. This configuration includes a portion 10 which may be referred to as an exterior boundary sidewall and a series of depending cell segments 11, 12, 13 and 14 which are formed integrally at a bottom edge 15 of the exterior boundary sidewall 10.

Figure 1:
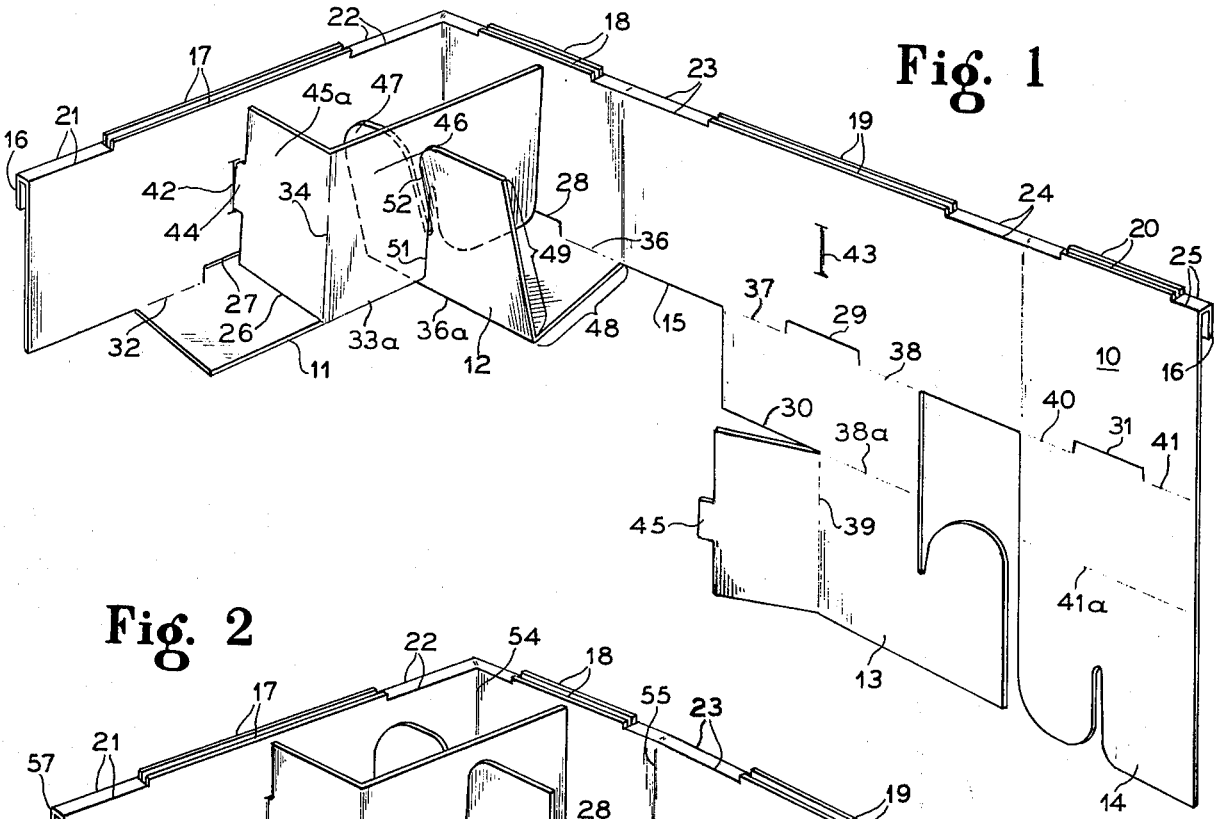
FIG. 1 is a perspective view of a partially-assembled and partially-unfolded carton insert according to the present invention.
Figure 2:
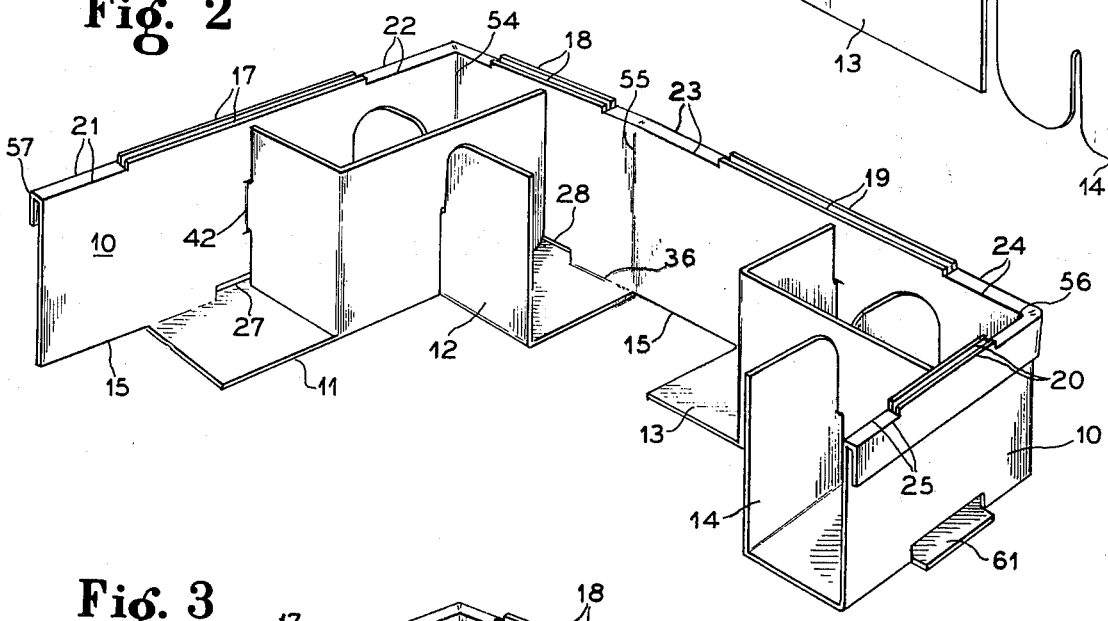
FIG. 2 is a view similar to FIG. 1 with the insert being in a further state of completion.

The upper edge of the exterior boundary sidewall 10 has a lip portion 16 which is folded, as shown in FIGS. 1 and 2, to form a cushion between the insert and the carton into which it is placed. The lip is severed at solid lines 17, 18, 19 and 20 and perforated at dash lines 21, 22, 23, 24 and 25, although other specific arrangements may be provided, depending on the type of die cutting device used.

The depending cell segments 11, 12, 13 and 14 are also severed at the solid lines 26 through 31 and perforated or scored at the dash lines 32 through 41. In addition, a pair of slits or slots or cuts 42 and 43 are provided in the exterior boundary sidewall to receive complementary tabs 44 and 45 which are formed at the edges of the cell segments 11 and 13.

Figure 3:
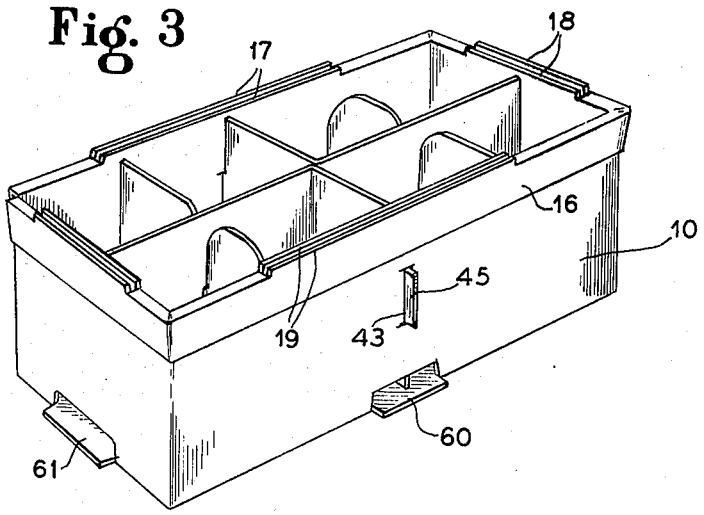
FIG. 3 is a perspective view of the carton insert in a completely folded and assembled condition.

The assembly of the carton insert according to the invention can be more clearly understood by reference to FIGS. 1 through 3. In FIG. 1 the cell segments 11 and 12 are folded at right angles to the exterior boundary sidewall 10, along the lines 32, 33, 35 and 36, respectively, as shown. A cell wall portion 45*a* is then folded along the line 34 and the tab 44 is then inserted into the slit or slot or cut 42 as shown. This provides corners for two adjacent cells. The remaining sidewalls of the cells are formed by a portion 46 of the cell segment 11 and a portion 47 of the cell segment 12. The cell segment 12 is folded as shown in FIG. 1, with a first folded portion 48 being folded along the lines 35 and 36 to form the bottom of two adjacent cells and a second folded portion 49 being folded along the line 36A to form sidewalls of the same two adjacent cells. A cell segment may be considered to have two fundamental parts, namely, first and second folded portions, identified as 48 and 49, 43*a* and 49 *a*, 48*b* and 49*b*, 48*c* and 49*c*. The first portion, designated as 48 *a*, *b*, or *c*, forms the bottom of two cells and the second portion, designated 49 *a*, *b*, or *c*, form sidewalls of two cells.

Referring back to FIG. 4, the depending segment 11 has an offset portion 50 which has a slit 51 as shown, to cooperate with a slit 52 formed in the folded portion 49 of the cell segment 12. As shown in FIG. 1, the respective slits are received within each other to interlock at the adjacent cell portions as shown.

Referring to FIG. 2, it can be seen that the depending cell segments 13 and 14 are folded in precisely the same manner as are the depending cell segments 11 and 12, with the result that the combination of the pair of cell segments 11 and 12 form portions of four cells and the combination of cell segments 13 and 14 form portions of four cells. When the exterior boundary sidewall 10 is folded along corners 54, 55 and 56, the entire assembly becomes closed as shown in FIG. 3, thereby completing the formation of eight individual interlock cells.

As shown in FIGS. 1 through 3, the lip 16 of FIG. 4 is folded into a U-shaped configuration, as identified by the numeral 57, prior to the folding of the exterior boundary sidewall at its corners and prior to the folding of any other part. This develops a cushion between the carton insert and the carton into which the insert is placed. As a result of the folding of the lip, there are upperly protruding segments of the cartons as shown at 17, 18, 19 and 20 in FIG. 2, when the lip 16 is made by perforations and slits but not when it is plainly perforated or scored.

The cushion effect is accomplished by means of the U-shaped folded lip 16 as well as by the tabs 44 and 45 which protrude through the exterior boundary sidewall as shown in FIG. 3 to effectively space the carton insert from the inner surface of a carton into which it is placed. Also, the manner in which the various cell segments, as shown in FIG. 4, are cut at 27, 28, 29 and 31 provides additional tabs 58, 59, 60 and 61, which also protrude beyond the outer surface of the exterior boundary sidewall 10 to assist the cushion effect. These tabs are shown in the protruding position in FIGS. 2 and 3, for instance.

Additional tabs similar to 58, 59, 60 and 61 can be provided along other scored lines such as 54, 55 and 56. Also the insert may be joined or closed by a variety of means such as glue, tape or tabs.

It is understood that the completed carton insert, as shown in FIG. 3, then fits snugly into an exterior carton with the cushion elements 16, 45 and 60, for example, providing a snug fit with the exterior carton. It will also be understood from the drawings that the various cells formed by the insert of this invention are interlocked with each other and provide a totally reinforced structure to prevent undesirable flexing of the sidewalls of the individual cells which could cause damage to the breakable items contained therein.

Figure 6:
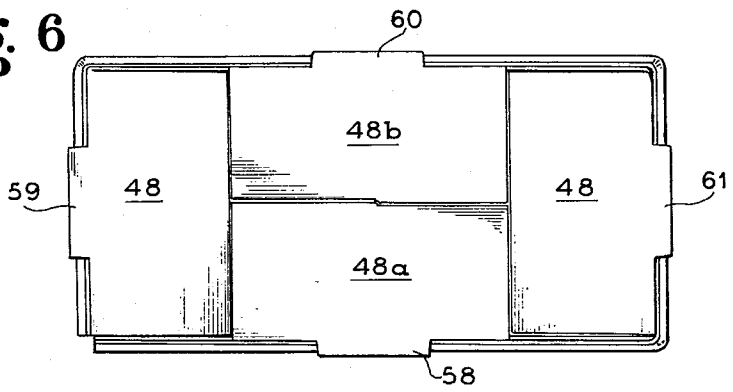
FIG. 6 is a bottom view of the carton insert as shown in FIGS. 3 and 5.
Figure 5:
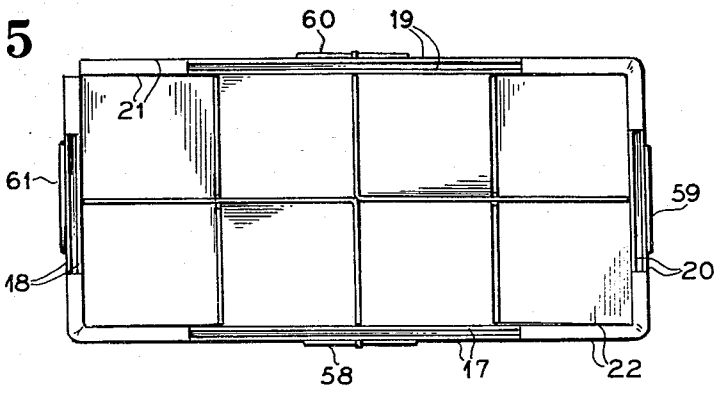
FIG. 5 is a top view of the carton insert as shown in FIG. 3.

FIGS. 5 and 6 show the completed structure of FIG. 3 in the top and bottom views. These figures will be self explanatory from the description of the assembly of the carton insert according to the previous figures. Accordingly, the present invention provides an improved multicell carton insert which is formed of one-piece contruction and which is designed to have the individual cells interlockable to form bottom and sidewalls, as well as to provide a cushion arrangement to protect breakable contents against damages.

I claim as my invention:

1. A one-piece multicell reinforced carton insert comprising:

an exterior boundary side wall, a plurality of cell segments integrally formed with said exterior boundary side wall and each being attached to the bottom edge of the side wall at spaced intervals therealong, each cell segment being folded to form at least a bottom and two interior side walls of two adjacent cells, and each cell segment being interlockable with at least one another adjacent cell segment to form a total reinforced structure.

2. A one-piece multicell reinforced carton insert as in claim 1 wherein each of said cell segments comprises at least first and second folded portions, said first folded portion forming the bottom and said second folded portion forming one side wall for each of two adjacent cells.

3. A one-piece multicell reinforced carton insert as in claim 2 wherein the second folded portion of each cell segment has an interlocking slit extending vertically thereof and substantially dividing said second folded portion into side walls of two adjacent cells and wherein the slits of adjacent cell segments extend in opposite directions for an interlocking fit.

4. A one-piece multicell reinforced carton insert in accordance with claim 2 wherein each alternate one of said cell segments has a cell side wall which is offset from the first folded portion thereof and which interlocks with a pair of cell side walls associated with two adjacent cells.

5. A one-piece multicell reinforced carton insert in accordance with claim 4 wherein said alternate ones of said cell segments each have an end cell side wall folded at a right angle to said second folded portion to generate a cell corner and wherein said end cell side wall has a tab protruding therefrom for being lockingly received by a cooperable slit in said exterior boundary side wall.

6. A one-piece multicell reinforced carton as in claim 4 wherein intermediate cell segments located between said alternate cell segments comprise said first folded portion which includes a planar section hinged to the exterior boundary side wall by a fold and said second folded portion which includes a planar section hinged to the first folded portion by a fold, said first and second folded portion being vertically aligned with one another.

7. A one-piece multicell reinforced carton insert as in claim 5 wherein said tab extends through said compartment exterior boundary side wall by a predetermined distance to space the outside surface thereof from the inside surface of a carton into which said insert is placed, thereby forming a cushion between the carton and the insert.

8. A one-piece multicell reinforced carton insert as in claim 7 wherein the first folded portion of said cell segments have tabs formed at the fold line with the exterior boundary side wall and extending outwardly a predetermined distance to space the outside surface thereof from the inside surface of a carton into which said insert is placed, thereby forming a cushion between the carton and the insert.

9. A one-piece multicell reinforced carton insert as in claim 8 wherein the upper edge of said exterior boundary side wall has a folded depending lip forming a U shaped cross section therewith to space the outside surface of the exterior boundary side wall from the inner surface of a carton into which the insert is placed, thereby forming a cushion between the carton and the insert.

10. A one-piece multicell reinforced carton insert as in claim 6 wherein one alternate and one intermediate cell segment form an interlocking pair and wherein said insert has two such pairs, said pairs being cooperable with each other together with said exterior boundary side wall for forming eight interior cells.

* * * * *